United States Patent [19]

Streich

[11] 4,367,983

[45] Jan. 11, 1983

[54] LEG CLOSURE

[75] Inventor: Steven G. Streich, Duncan, Okla.

[73] Assignee: Halliburton Company, Duncan, Okla.

[21] Appl. No.: 221,125

[22] Filed: Dec. 29, 1980

[51] Int. Cl.[3] ..... E02D 5/52

[52] U.S. Cl. ..... 405/227; 138/89; 428/109; 405/225

[58] Field of Search ..... 405/224–227, 405/195; 428/109–112; 156/92, 155, 177; 138/89–94

[56] References Cited

U.S. PATENT DOCUMENTS

| | | | |
|---|---|---|---|
| 1,427,708 | 8/1922 | Williams | 428/109 |
| 1,860,090 | 5/1932 | Fowler | 428/111 |
| 3,533,241 | 10/1970 | Bowerman et al. . | |
| 3,644,165 | 2/1972 | Chen | 428/110 |
| 3,788,162 | 1/1974 | Rabenhorst et al. | 156/177 X |
| 4,024,723 | 5/1977 | Mayfield et al. . | |
| 4,178,112 | 12/1979 | Knox | 405/227 |
| 4,220,422 | 9/1980 | Sullaway | 405/225 |
| 4,230,424 | 10/1980 | Sullaway | 405/225 X |

*Primary Examiner*—Dennis L. Taylor

*Attorney, Agent, or Firm*—James R. Duzan; Thomas R. Weaver

[57] ABSTRACT

A closure of reinforced elastomeric material having layers or plies of reinforcing means bonded or secured to one or more reinforcing members in the outer periphery of the closure wherein each layer or ply of reinforcing means is comprised of a plurality of strips of fabric, each strip being angularly located with respect to another in the same layer or ply and with respect to another in an adjacent layer ply.

11 Claims, 4 Drawing Figures

LEG CLOSURE

BACKGROUND OF THE INVENTION

This invention relates to an improved closure diaphragm for offshore platforms used in well drilling and production.

Offshore platforms are generally fabricated in a harbor or on a shore location and are then towed to a marine site where they are tipped on end and lowered into position with the platform resting on the ocean floor. The platform legs are hollow structures having open ends so that pilings can be driven downwardly through the legs into the subterranean formations below the ocean floor to anchor the platform in position.

It is desirable during platform setting operations to utilize the platform legs and/or pile sleeves for buoyancy to assist in the setting operations. It is also desirable to exclude foreign material from the platform leg and/or pile sleeve during platform setting operations to prevent the annulus between the piling and the platform leg and/or pile sleeve from becoming contaminated with foreign material which would prevent the filling of the annulus with cement or grout. Therefore, a closure structure which is easily severable when the piling is driven through the platform leg and/or pile sleeve is used to seal the end of the platform leg and/or pile sleeve during setting of the platform.

Typical prior art closure structures, generally referred to as closures or diaphragms, utilized to seal the end of a platform leg and/or pile sleeve of an offshore platform, are illustrated in U.S. Pat. Nos. 3,533,241, 4,024,723, 4,178,112, 4,220,422 and 4,230,424. While these closures are generally satisfactory, all utilize layers or plies of reinforcing material comprised of unitary pieces of fabric to reinforce the closure.

SUMMARY OF THE INVENTION

When installed on the jacket leg and/or pile sleeve of an offshore platform, during platform setting or installation operations, a closure is deformed into a generally hemispherical shape due to the hydrostatic loading of the closure by the water. Since a closure is reinforced by unitary layers or plies of either woven fabric having longitudinal (warp) threads and fill (weft) threads at right angles thereto or fabric having essentially longitudinal (warp) threads only retained in a matrix of elastomeric material, i.e., calendared with a rubber coating, when hydrostatically loaded, the layers or plies of fabric are also deformed into a generally hemispherical shape. Since some of the threads of such fabrics will lie along lines other than radial lines of a horizontal plane of the closure, it is apparent that the loading of the closure will not be evenly distributed about each layer or ply of fabric.

Therefore, ideally, to uniformly distribute the load throughout each layer or ply of fabric when the closure is subjected to hydrostatic loading which will tend to deform the closure into a hemispherical shape, each layer or ply of fabric should be comprised of threads which will have a radial orientation in a horizontal plane of the closure.

In the prior art closures, attempts to obtain radial orientation of the threads of the fabrics were made by angularly rotating each layer or ply of fabric with respect to each other in the closure. The degree of angular rotation of each layer or ply of fabric with respect to another being determined by dividing the total number of layers or plies of fabric in the closure or diaphragm into 180 degrees.

In contrast to the prior art closures having layers or plies of reinforcing material comprised of unitary pieces of fabric, the closure of the present invention comprises a closure of reinforced elastomeric material having layers or plies of reinforcing means bonded or secured to one or more reinforcing members in the outer periphery of the closure wherein each layer or ply of reinforcing means is comprised of a plurality of strips of fabric, each strip being angularly located with respect to another in the same layer or ply and with respect to another in an adjacent layer or ply such that the number of longitudinal threads of the fabric of the strips of each layer or ply generally extending along radial lines of a horizontal plane of the closure is maximized. In this manner, when subjected to hydrostatic loading which deforms the closure into a generally hemispherical shape, the loading throughout each layer or ply of fabric will be more uniform than in the prior art closures because a greater number of threads will be located along radial lines of a horizontal plane of the closure.

The advantages and the preferred embodiments of the present invention will be more fully understood from the following specification taken in conjunction with the accompanying drawings wherein:

DESCRIPTION OF THE INVENTION

Figure 1:
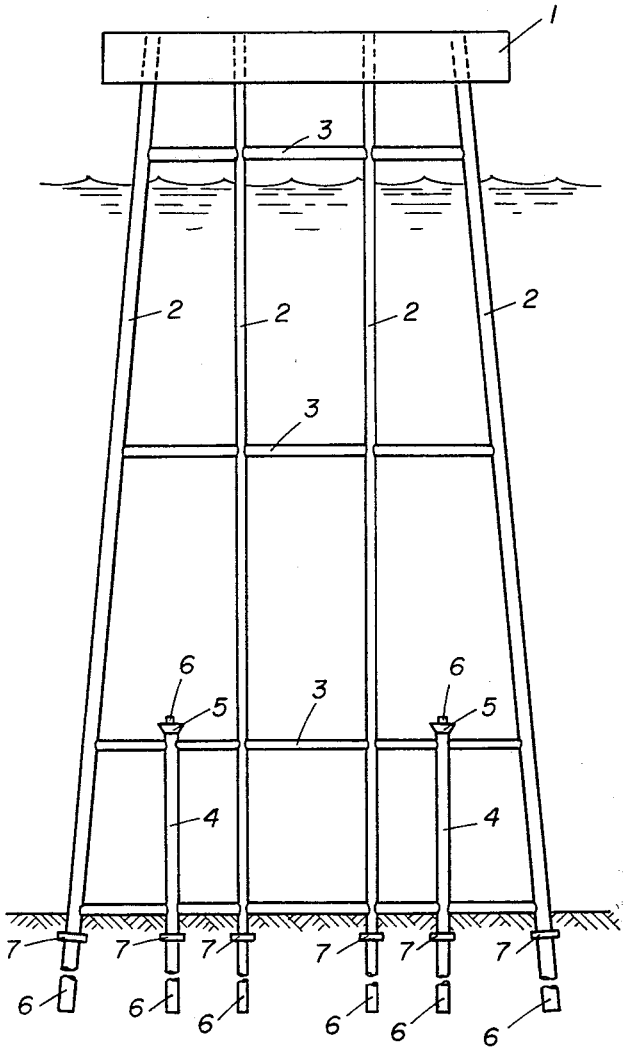
FIG. 1 is a side elevational view of a marine platform having tubular supporting legs and piling guide sleeves between the legs resting on the bottom of a body of water with the present invention installed on the lower end of the legs and sleeves.

Referring to FIG. 1, the present invention is shown installed on a marine platform. A marine platform 1 is shown having tubular supporting legs 2 between which horizontal reinforcing members 3 are connected in the usual manner. Tubular piling guide sleeves 4, which may have flared upper ends 5, are supported between the lower end portion of the legs 2 by the lower reinforcing members 3 and, with the legs, are adapted to rest upon or have their lower extremities embedded in the bottom of a body of water.

The sleeves 4 and legs 2 are secured to the earth by driving a piling 6 to refusal or to a predetermined depth into the bottom of the body of water. Upon completion of the pile driving, the annulus between each sleeve 4 and/or leg 2 and its associated piling 6 may be filled with cement or grout to provide a unitary base structure.

Contained on the bottom of each leg 2 and guide 4 is a rupturable seal assembly 7 which embodies the principles of the present invention.

Figure 2:
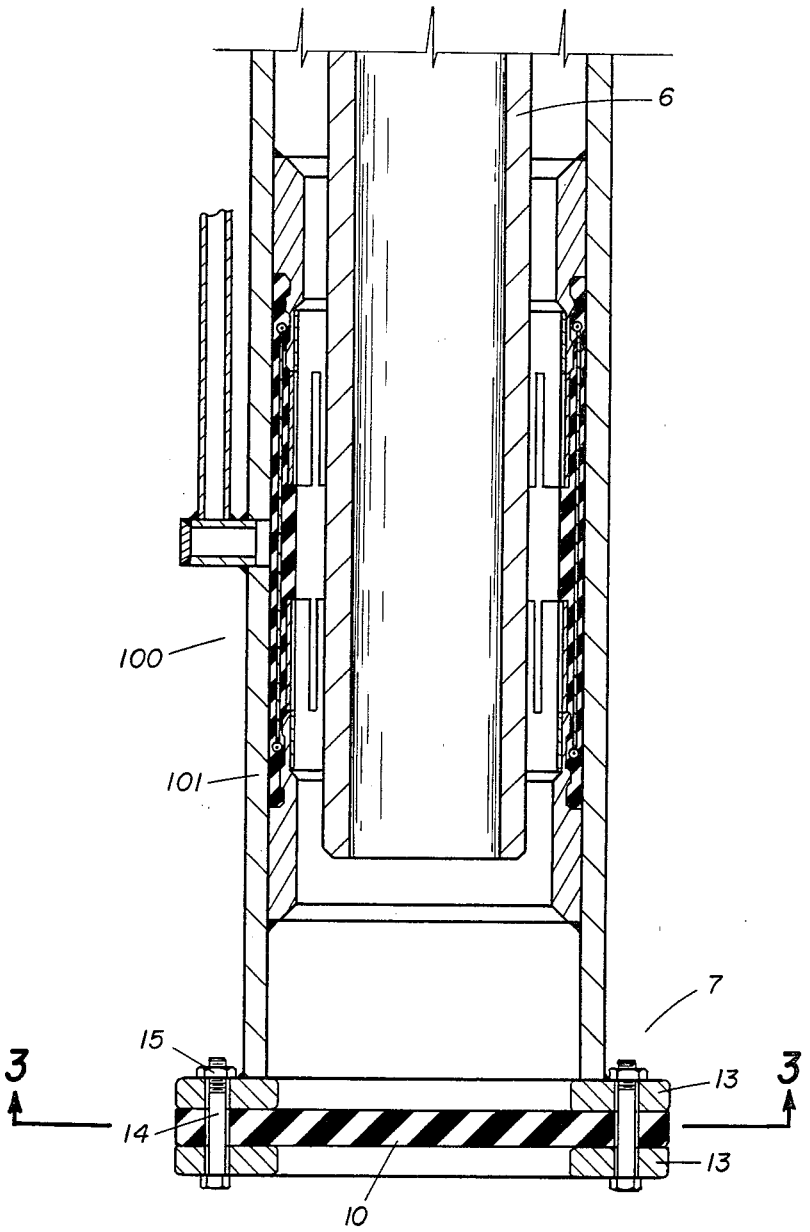
FIG. 2 is a cross-sectional view of the present invention in a typical installation in a leg or piling guide sleeve.

Referring to FIG. 2, the seal assembly 7 is shown in relation to an inflatable packer assembly 100 installed at the bottom of a leg 2 or guide sleeve 4. As shown, the closure or diaphragm 10 is relatively thin compared to its diameter.

For mounting the seal assembly 7 on the lower end of the inflatable packer assembly 100, a pair of flat annular plates 13 is provided with the plates 13 being adapted to be releasably secured to each other about their outer periphery by a plurality of bolts 14 and nuts 15. The upper annular plate 13 is adapted to be secured to the lower end of the packer housing 101 by welding, although any suitable means of securing the plate 13 may be used. If no inflatable packer is installed on the bottom of the leg 2 or guide sleeve 4, alternatively, the plate 13 may be secured to the bottom of the leg 2 or guide sleeve 4.

As shown, the seal assembly closes the lower end of the inflatable packer assembly 100 which is secured to a leg 2 or guide sleeve 4 through which a piling is to be driven to facilitate floating of the platform to its point of installation, as well as preventing the entrance of silt and other debris into the leg 2 or guide sleeve 4 during the installation of the platform. To position the platform legs 2 and guide sleeves 4 on the bottom of the body of water, it is necessary to waterflood some or all of the legs 2 or guide sleeves 4. After rupturing of the closure or diaphragm 10 by the piling 6 being driven into the bottom, the closure or diaphragm 10 and the water located thereabove acts to help prevent entry of foreign material into the leg 2 or guide sleeve 4, although during driving of the piling 6, an amount of foreign material will be introduced into the leg 2 or guide sleeve 4.

Although not shown, the closure or diaphragm 10 may be secured to the jacket leg or pile sleeve of the platform by means of two annular plates having flat confronting faces with inwardly tapered enlarged ends to retain the closure or diaphragm therebetween by means of an interference fit therewith.

Figure 3:
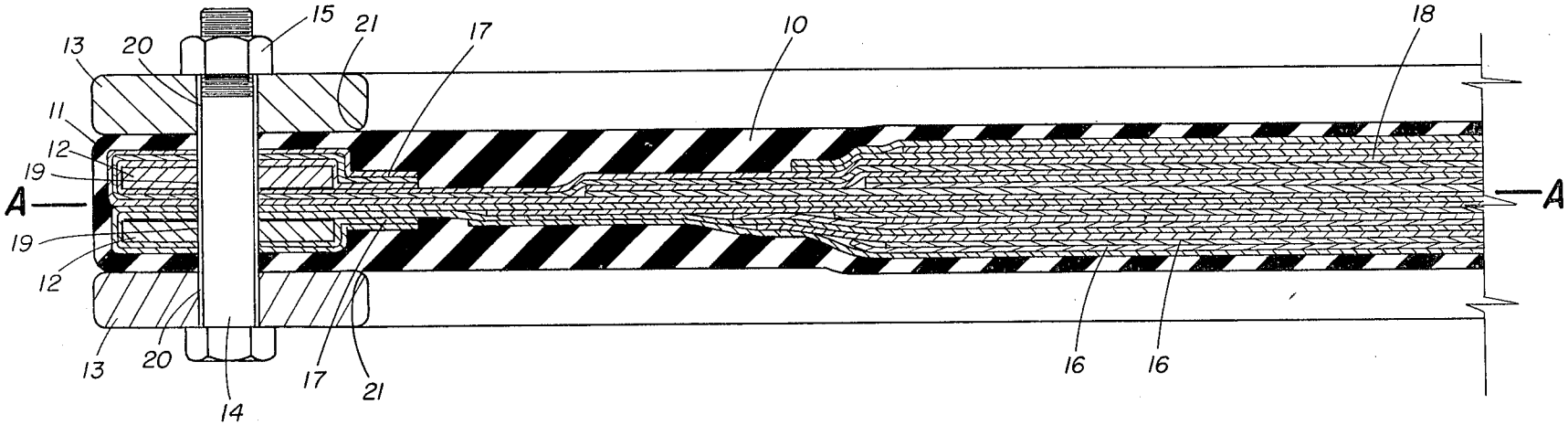
FIG. 3 is an enlarged broken cross-sectional view of an embodiment of the present invention taken along line 3—3 of FIG. 2.

Referring to FIG. 3, a preferred embodiment of the present invention is shown. The closure or diaphragm 10 comprises a flexible member of rubber, synthetic rubber or other suitable elastomeric material. To reinforce the closure or diaphragm 10, a plurality of layers 16 of fabric are bonded or secured within the closure or diaphragm 10 with the outer periphery of the layers 16 of fabric being wrapped about and bonded or secured to metal reinforcing members 12 with the ends 17 of the layers 16 of fabric extending into the inner portion of the closure or diaphragm 10. Any number of layers 16 of fabric may be used to reinforce the closure 10 depending upon the desired strength of the closure. The layers 16 of fabric used to reinforce the closure 10 may be of any suitable material, such as rayon, nylon, polyester, steel, a fabric sold under the trademark Kevlar by the DuPont Company, etc., although nylon fabric is preferred.

Each layer 16 of fabric in the present invention is formed of a plurality of strips of fabric, each strip being angularly located with respect to another in the same layer and with respect to another in an adjacent layer such that the number of longitudinal threads in the strips of fabric of each layer generally extending along radial lines of a typical horizontal plane A—A of the closure or diaphragm 10 are maximized. In the closure 10 shown, each layer 16 of fabric is comprised of five (5) strips of fabric which are rotated thirty-six (36) degrees with respect to another strip in the same layer 16, rotated eighteen (18) degrees to another strip of another adjacent layer 16 wrapped and bonded or secured about the same reinforcing member 12, and rotated nine (9) degrees with respect to another strip and their adjacent layer 16 wrapped and bonded or secured about another adjacent reinforcing member 12. Since there are four layers 16 of fabric in the closure 10, two layers 16 each wrapped and bonded or secured about a reinforcing member 12, comprised of five (5) strips of fabric each, in the center 18 of the closure or diaphragm 10 where the strips of each layer 16 of fabric overlay one another, twenty (20) strips of fabric are present. It should be noted that even though there are four layers 16 of fabric in the closure 10, as shown in FIG. 3 due to the arrangement of the strips of fabric comprising each layer depending upon the location of the cross-sectional view it may appear as though more than two layers 16 of fabric are wrapped about the reinforcing member 12. For instance, in the cross-sectional view shown in FIG. 3, three strips of fabric comprising a portion of two layers 16 of fabric in the closure 10 are shown wrapped and secured to one reinforcing member 12 while two strips of fabric comprising a portion of two layers 16 of fabric in the closure 10 are wrapped and secured about the other reinforcing member 12.

It should be understood that while the closure 10 of the present invention has been illustrated or shown having reinforcing means comprising four (4) layers of fabric, each layer 16 being comprised of five (5) strips of fabric, based upon the size of the closure 10 the number of strips comprising each layer 16 will vary depending upon the desired number of threads of the fabric of each strip to be located along generally radial lines of a horizontal plane of the closure 10 while the number of layers 16 will vary depending upon the desired strength of the closure or diaphragm 10. It should be further understood that the greater number of threads of the fabric of each strip located along generally radial lines of horizontal plane of the closure 10 the more uniform the loading by the hydrostatic pressure of the water, which tends to cause the closure or diaphragm 10 to be deformed into a hemispherical shape, during platform setting or installation will result thereby yielding a closure 10 having improved strength characteristics.

The metal reinforcing members 12 are formed having a generally rectangular cross-sectional configuration and a plurality of holes 19 therein. Although the thickness of the metal reinforcing member 12 may vary when considering the cross-sectional thickness of the member in proportion to the cross-sectional width of the member, the cross-sectional thickness of the member should be relatively small in proportion to the cross-sectional width of the member. However, if the cross-sectional thickness of the member 12 is too small, when the member 12 is highly stressed, it will initially buckle inwardly causing a wrinkle in the closure or diaphragm 10 thereby allowing fluid to enter the jacket leg 2 or guide sleeve 4 until the loading on the closure 10 is sufficient to tear the layers 16 of fabric. This causes massive failure of the closure or diaphragm 10 and not merely a leak between the annular flat plates 13.

The annular flat plates 13 are formed having a plurality of holes 20 therein and inner radiused edges 21 thereon to provide a smooth bearing surface for the closure 10 to bear against under loading. It should be noted that it is important to have the ends 17 of the layers 16 of fabric used to reinforce the closure 10, which are wrapped and bonded or secured to the reinforcing members 12, extend a distance into the inner portion of the closure when they are bonded or secured in position. When the closure 10 is deflected by the force of the water, the inner portion of the outer periphery 11 contacts the inner radiused edge 21 of the annular flat plate 13 secured to the packer housing 101. By having ends 17 of the layers 16 of the fabric reinforcing the closure 10 terminating inwardly of the annular flat members 13 after they are wrapped and bonded or secured to the reinforcing members 12, this acts as additional reinforcement for the closure 10 to help prevent any failure of the closure 10 by tearing of the layers 16 of fabric at the outer periphery 11 of the closure 10 which is retained between the annular flat plates 13.

The closure 10 is positively held between the annular flat plates 13 by means of bolts 14 and nuts 15 extending therethrough. The annular flat plates 13 may be formed having any desired cross-sectional thickness and cross-sectional width provided that the cross-sectional width is at least as great as the cross-sectional width of the reinforcing members 12 in the periphery 11 of the closure 10.

Figure 4:
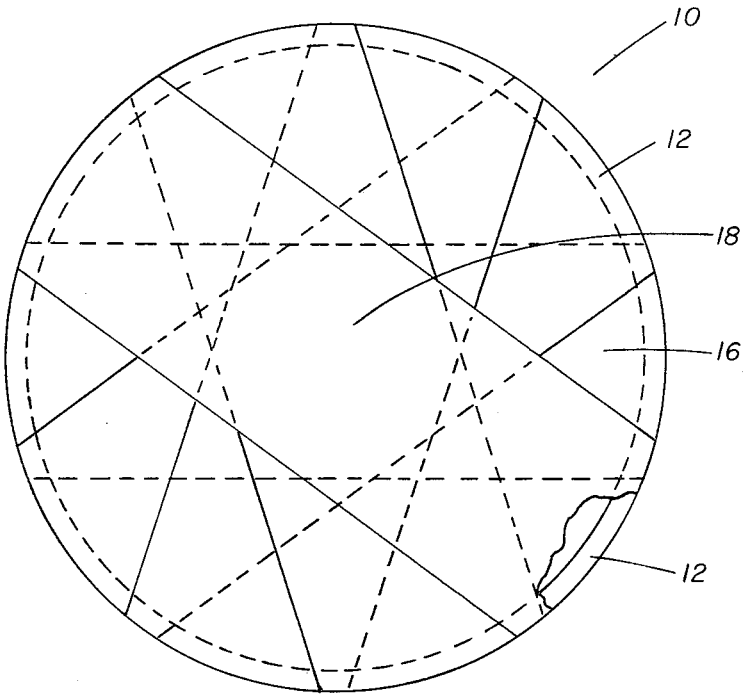
FIG. 4 is a planform view or top view of the present invention.

Referring to FIG. 4, the closure 10 of the present invention is shown in planform or in top view having the holes 19 in the outer periphery 11 thereof deleted and having the strips of fabric comprising each layer 16 which do not overlay another adjacent strip of fabric in this view shown in solid lines, although such strips have a covering of elastomeric material thereover.

It should be evident from the foregoing that the closure 10 of the present invention offers advantages over the prior art closures.

By maximizing the numbers of threads of each layer of fabric which are oriented generally along radial lines of a horizontal plane of the closure each layer of fabric will exhibit more uniform loading than a layer of fabric comprised of a unitary piece, hence, will be stronger in comparison because of a greater number of threads of each layer will be more uniformly loaded thereby decreasing the number of layers of fabric required for the closure.

By utilizing strips of fabric to form each layer of fabric used to reinforce the closure the cost of fabric is reduced for the closure or diaphragm in comparison to a closure having unitary layers of fabric therein because the strips of fabric can be formed from narrow pieces of fabric which are less expensive than large unitary pieces of fabric.

Since a closure wherein each layer of fabric is comprised of a plurality of strips of fabric generally requires fewer layers of fabric to achieve the same level of strength as a closure comprised of a plurality of layers of unitary pieces of fabric, the closure of the present invention is more easily pierced by a piling being driven therethrough than the prior art closures.

The closure is easily constructed using simple wrapping of the layers of fabric reinforcing the closure around the reinforcing members in the outer periphery of the closure.

The annular flat plates retaining the closure have simple shapes requiring little machining for use.

The closure is positively retained between the annular flat plates to prevent release therefrom.

The reinforcing members in the periphery of the closure are simple geometric shapes which can be easily constructed.

The closure can be used with a variety of types of annular flat plates to retain the closure on the leg or guide sleeve of an offshore platform.

Having thus described my invention, I claim:

1. In combination, a closure and an annular closure retaining means retaining said closure therein for closing the bore of a tubular support member of a marine platform located in a body of water or other similar structure located in a fluid environment, wherein said closure comprises:

circular flexible member means having a peripheral portion and an inner portion;

annular reinforcing member means located in the peripheral portion of the circular flexible member means; and reinforcing means having a peripheral portion and an inner portion contained within the circular flexible member means, the reinforcing means comprising at least one layer of reinforcing means, each layer of reinforcing means comprising a plurality of strip means, each strip means comprising a strip of fabric having longitudinal threads and one or more fill threads, being secured to adjacent strip means and to the annular reinforcing member means and having the longitudinal threads therein generally extending along radial lines of a horizontal plane of said closure such that when said closure is subjected to loading by the hydrostatic pressure of said water or fluid the longitudinal threads are subjected to substantially uniform loading.

2. The combination of claim 1 wherein:

the reinforcing means comprises a plurality of layers of reinforcing means; and the annular reinforcing member means comprises a plurality of annular reinforcing member means, each annular reinforcing member means of the plurality of annular reinforcing member means having at least one layer of the plurality of layers of reinforcing means being wrapped and secured thereto.

3. The combination of claim 1 wherein the inner portion of the reinforcing means is disposed within the inner portion of the circular flexible member means and the peripheral portion of the reinforcing means is disposed within the peripheral portion of the circular flexible member means being wrapped and secured to the annular reinforcing member means having the peripheral portion terminating inwardly of the reinforcing member means and the inner diameter of said annular closure retaining means wherein a portion of the peripheral portion of the reinforcing means overlays a portion of the inner portion of the reinforcing means.

4. The combination of claim 3, wherein:

the plurality of reinforcing member means comprise a plurality of annular substantially rectangular cross-sectionally shape reinforcing member means; and the plurality of layers of reinforcing means comprise a plurality of layers of fabric.

5. The combination of claim 4 wherein:

said closure is retained by said closure retaining means by means of a plurality of fasteners extending through said closure retaining means, through the circular flexible member means of said closure, through the annular reinforcing means of said closure and through the reinforcing means of said closure.

6. In combination, a closure and an annular closure retaining means retaining said closure therein for closing the bore of a tubular support member of a marine platform or other similar structure, wherein said closure comprises:

circular flexible member means having a peripheral portion and an inner portion;

annular reinforcing member means located in the peripheral portion of the circular flexible member means; and reinforcing means having a peripheral portion and an inner portion contained within the circular flexible member means, the reinforcing means comprising at least one layer of reinforcing means, each layer of reinforcing means comprising a plurality of strip means, each strip means being secured to adjacent strip means and secured to the annular reinforcing member means; and wherein said annular closure retaining means comprises:

a pair of annular flat plates releasably secured to each other retaining said closure therebetween, said annular closure retaining means having one of the pair of annular plates secured to the bottom of a tubular support member of said marine platform or said similar structure thereby closing said bore of said tubular support by said closure and said closure retaining means being installed thereon.

7. The combination of claim 6, wherein:

the reinforcing means comprises a plurality of layers of reinforcing means; and the annular reinforcing member means comprises a plurality of annular reinforcing member means, each annular reinforcing member means of the plurality of annular reinforcing member means having at least one layer of the plurality of layers of reinforcing means being wrapped and secured thereto.

8. The combination of claim 6 wherein the inner portion of the reinforcing means is disposed within the inner portion of the circular flexible member means and the peripheral portion of the reinforcing means is disposed within the peripheral portion of the circular flexible member means being wrapped and secured to the annular reinforcing member means having the peripheral portion terminating inwardly of the reinforcing member means and the inner diameter of said annular closure retaining means wherein a portion of the peripheral portion of the reinforcing means overlays a portion of the inner portion of the reinforcing means.

9. The combination of claim 8 wherein:

the plurality of reinforcing member means comprise a plurality of annular substantially rectangular cross-sectionally shaped reinforcing member means; and the plurality of layers of reinforcing means comprise a plurality of layers of fabric.

10. The combination of claim 9 wherein:

said closure is retained by said closure retaining means by means of a plurality of fasteners extending through said closure retaining means, through the circular flexible member means of said closure, through the annular reinforcing means of said closure and through the reinforcing means of said closure

11. In combination, a closure and an annular closure retaining means retaining said closure therein for closing the bore of a tubular support member of a marine platform or other similar structure, wherein said closure comprises:

circular flexible member means having a peripheral portion and an inner portion;

annular reinforcing member means located in the peripheral portion of the circular flexible member means; and reinforcing means having a peripheral portion and an inner portion contained within the circular flexible member means, the reinforcing means comprising at least one layer of reinforcing fabric means, each layer of reinforcing fabric means comprising a plurality of strips of fabric means, each strip of fabric means being secured to adjacent strips of fabric means, wherein the inner portion of the reinforcing means is disposed within the inner portion of the circular flexible member means and the peripheral portion of the reinforcing means is disposed within the peripheral portion of the flexible member means being wrapped and secured to the annular reinforcing member means having the peripheral portion terminating inwardly of the reinforcing member means and the inner diameter of said annular closure retaining means wherein a portion of the peripheral portion of the reinforcing means overlays a portion of the inner portion of the reinforcing means; and wherein said annular closure retaining means comprises:

a pair of annular flat plates releasably secured to each other retaining said closure therebetween, said annular closure retaining means having one of the pair of annular plates secured to the bottom of a tubular support member of said marine platform or said similar structure thereby closing said bore of said tubular support by said closure and said closure retaining means being installed thereon.

* * * * *